US008774441B2

(12) United States Patent
Miyazawa

(10) Patent No.: US 8,774,441 B2
(45) Date of Patent: Jul. 8, 2014

(54) HEADPHONE

(75) Inventor: Takayuki Miyazawa, Kawasaki (JP)

(73) Assignee: JVC Kenwood Corporation, Yokohama-Shi, Kanagawa (JP)

( * ) Notice: Subject to any disclaimer, the term of this patent is extended or adjusted under 35 U.S.C. 154(b) by 0 days.

(21) Appl. No.: 13/614,439

(22) Filed: Sep. 13, 2012

(65) Prior Publication Data

US 2013/0083955 A1 Apr. 4, 2013

(30) Foreign Application Priority Data

Sep. 30, 2011 (JP) ..... 2011-217180
Sep. 30, 2011 (JP) ..... 2011-217184
Sep. 30, 2011 (JP) ..... 2011-217204

(51) Int. Cl.
*H04R 21/02* (2006.01)

(52) U.S. Cl.
USPC ..... 381/367; 381/376; 381/380; 381/370; 381/374

(58) Field of Classification Search
USPC ..... 381/370, 371, 380, 367, 376, 374
See application file for complete search history.

(56) References Cited

U.S. PATENT DOCUMENTS

2002/0094094 A1* 7/2002 Shin ..... 381/104

FOREIGN PATENT DOCUMENTS

JP 5-199579 A 8/1993

* cited by examiner

*Primary Examiner* — Davetta W Goins
*Assistant Examiner* — Amir Etesam
(74) *Attorney, Agent, or Firm* — Nath, Goldberg & Meyer; Jerald L. Meyer

(57) ABSTRACT

A headphone includes: a housing, a hanger, and a bracket accommodated in the housing. The hanger includes: a connecting portion formed in a ring-shape; and a pair of engagement portions opposite to each other in a radial direction of the connecting portion and supports the housing unit to allow the housing unit to rotate. The bracket includes: a flexible curved base; and a pair of protrusions protruding at both ends of the base portion in directions away from each other on an axis penetrating the both ends. The housing includes a pair of through holes at positions corresponding to the pair of engagement portions. The pair of protrusions is rotatably engaged with the pair of engagement portions through the pair of through holes.

8 Claims, 16 Drawing Sheets

HEADPHONE

CROSS REFERENCE TO RELATED APPLICATION

This application is based upon and claims the benefit of priority under 35 U.S.C. §119 to Japanese Patent Applications No. P2011-217180, filed on Sep. 30, 2011, No. P2011-217184, filed on Sep. 30, 2011, and No. P2011-217204, filed on Sep. 30, 2011, the entire contents of which are incorporated herein by reference.

BACKGROUND

The embodiment relates to a headphone and specifically relates to a headphone including a hanger which connects a headband to each housing, a portion of the hanger connected to the housing has a ring shape.

One of known headphones includes: a head band; housings accommodating speakers; and hangers connecting the head band and the respective housings, a portion of each hanger connected to the corresponding housing unit (hereinafter referred to as a connecting portion) has a U shape. An example of such type of headphones is described in Japanese Patent Laid-open Publication No. 5-199579 (Patent Literature 1).

In the headphone described in Patent Literature 1, the connecting portion of the hanger is made of resin and has a U shape. At the respective ends of the U shape, a pair of support pins is individually protruded toward each other. In each housing unit, insertion holes which receive the pair of support pins are formed.

In the assembly of the headphone, the hanger is attached to the housing unit by the following operations. The ends of the U-shaped connecting portion are elastically forced apart, and the housing unit is placed between the ends. In the process of restoring the hanger to the original shape, the pair of support pins is inserted into the respective insertion holes.

SUMMARY

In recent years, headphones are rapidly spreading, and the attention is focused on not only the acoustic characteristics of the headphones but also exterior designs thereof. The hangers are important parts for the appearance of the headphones and serve as design accents. Accordingly, the hangers in which the connecting portions connected to the respective housings have closed ring shape, instead of U shape with open ends, are proposed and commercialized.

Such a hanger having a ring-shaped connecting portion is expected to be attached to the housing in the following manner. In the connecting portion, a pair of support pins protruding toward each other in a radial direction is formed. The housing is provided with insertion holes corresponding to the pair of support pins. The pair of support pins is engaged with the insertion holes to attach the hanger to the housing.

In such a case, for the hunger has a closed ring shape, it is difficult to attach the hanger to the housing by elastically deforming and widening the hanger in a similar manner to the U-shaped hanger.

As shown in FIG. 1, by using elastic deformation of a U-shaped hanger 102, which is made of resin from the base of each arm of the U-shape to the end thereof (a range indicated by D100), earpieces of the headphone can swivel.

The swivel refers to rotation (indicated by an arrow DR100) of an earpiece around an axis CL 100, which extends substantially in the vertical direction when the headphone is worn over the head. It is preferable that swivel be performed against proper resistive force because such headphones with swivel earpieces can provide a better fit.

In the headphone including the conventional U-shaped hanger 102, which is made of resin, the swivel can be performed against proper resistive force without requiring additional components.

However, the hanger including a ring-shaped connecting portion can elastically deformed very little because the connecting portion has a closed shape. Accordingly, the swivel cannot be substantially performed only by elastic deformation of the hanger. This problem is desired to be improved.

An object to be solved by the embodiment is to provide a headphone which can implement the swivel to provide a good fit even if the headphone includes a hanger provided with a ring-shaped connecting portion.

In order to solve the aforementioned conventional technical problem, an aspect of the embodiment provides a headphone comprising: a housing; a hanger which includes: a connecting portion formed in a ring-shape; and a pair of engagement portions opposite to each other in a radial direction of the connecting portion and supports the housing unit to allow the housing unit to rotate; and a bracket which is accommodated in the housing and includes: a flexible curved base; and a pair of protrusions protruding at both ends of the base portion in directions away from each other on an axis penetrating the both ends, in which the housing includes a pair of through holes at positions corresponding to the pair of engagement portions, and the pair of protrusions are rotatably engaged with the pair of engagement portions through the pair of through holes.

DETAILED DESCRIPTION

Figure 1:
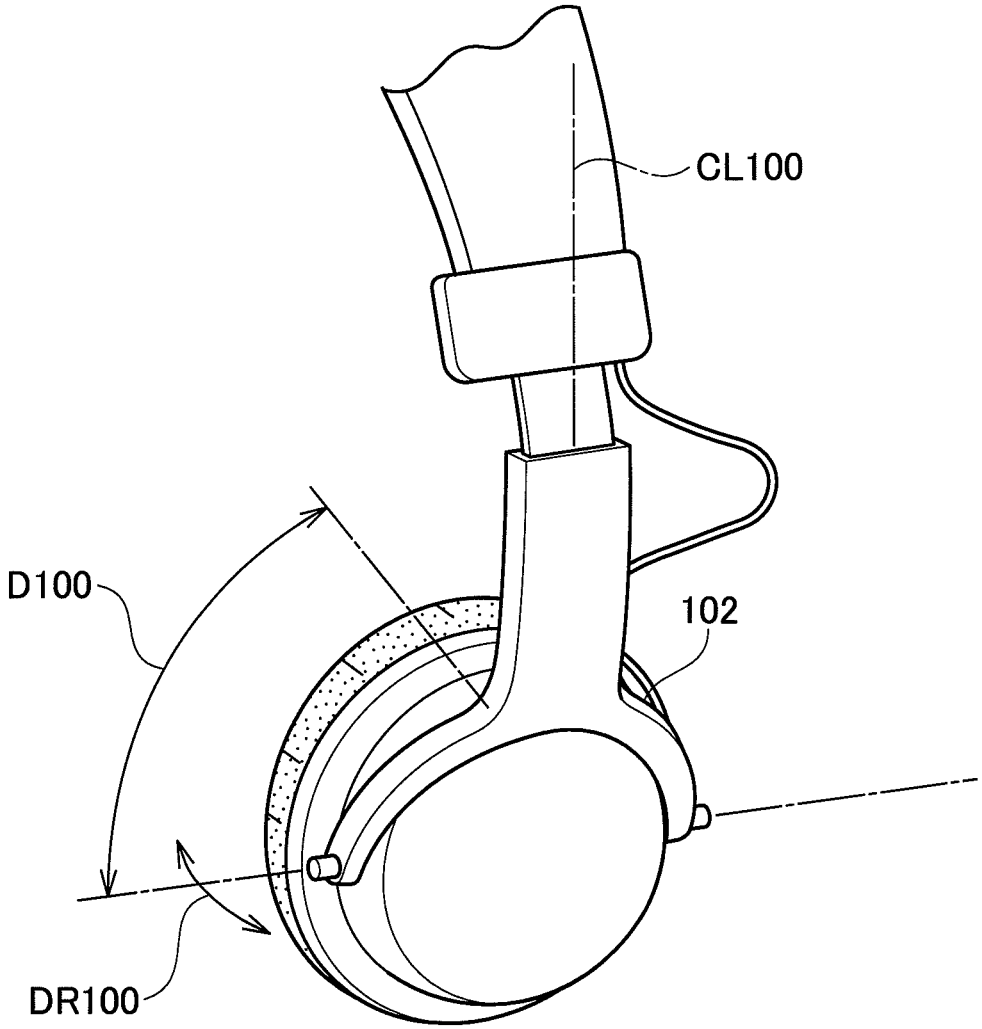
FIG. 1 is a perspective view for explaining a conventional headphone.
Figure 2:
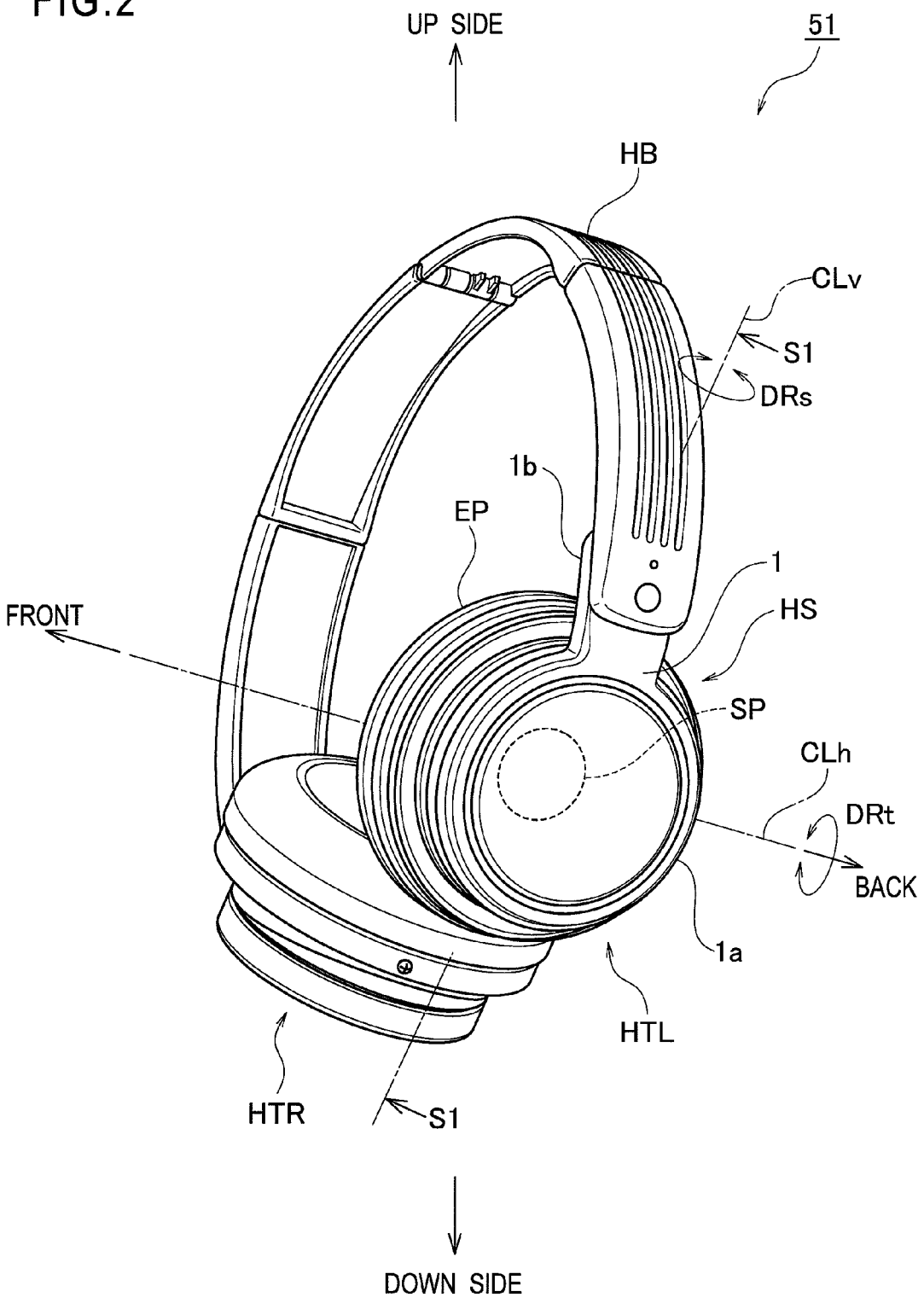
FIG. 2 is an exterior perspective view for explaining an embodiment of a headphone.

With reference to FIGS. 2 to 16, a description is given of an aspect of the embodiment using a preferred example. FIG. 2 is an exterior perspective view showing a headphone 51 as an embodiment of a headphone.

The headphone 51 is a so-called overhead type including a main unit HTL for a left ear and a main unit HTR for a right ear, which are connected by a headband HB.

The main units HTL and HTR have symmetrical shapes, and the following description is given of the main unit HTL except as otherwise noted. Moreover, up, down, front, back, inward, and outward directions are defined and shown in the drawings when needed.

As shown in FIG. 2, the main unit HTL includes: a housing HS accommodating a speaker SP inside; a hanger 1 including a ring-shaped connecting portion la, which supports the housing HS so as to rotate the same in a predetermined angular range around an axis CLh; and an ear pad EP detachably attached to the housing HS. The headband HB is connected to an arm portion lb of the hanger 1.

In the main unit HTL, the housing HS is rotatable relative to the hanger 1 in a predetermined angular range around an axis CLv (in the direction of an arrow DRs, see FIG. 4), which extends in the vertical direction orthogonal to the axis CLh, which extends in the front-back direction. That is to say, the main unit HTL is capable of swiveling.

Moreover, in the main unit HTL, the housing HS is rotatable relative to the hanger 1 in a predetermined angular range around the axis CLh (in the direction of an arrow DRt, see FIG. 3), which extends in the front-back direction. That is to say, the main unit HTL is capable of tilting.

Figure 3:
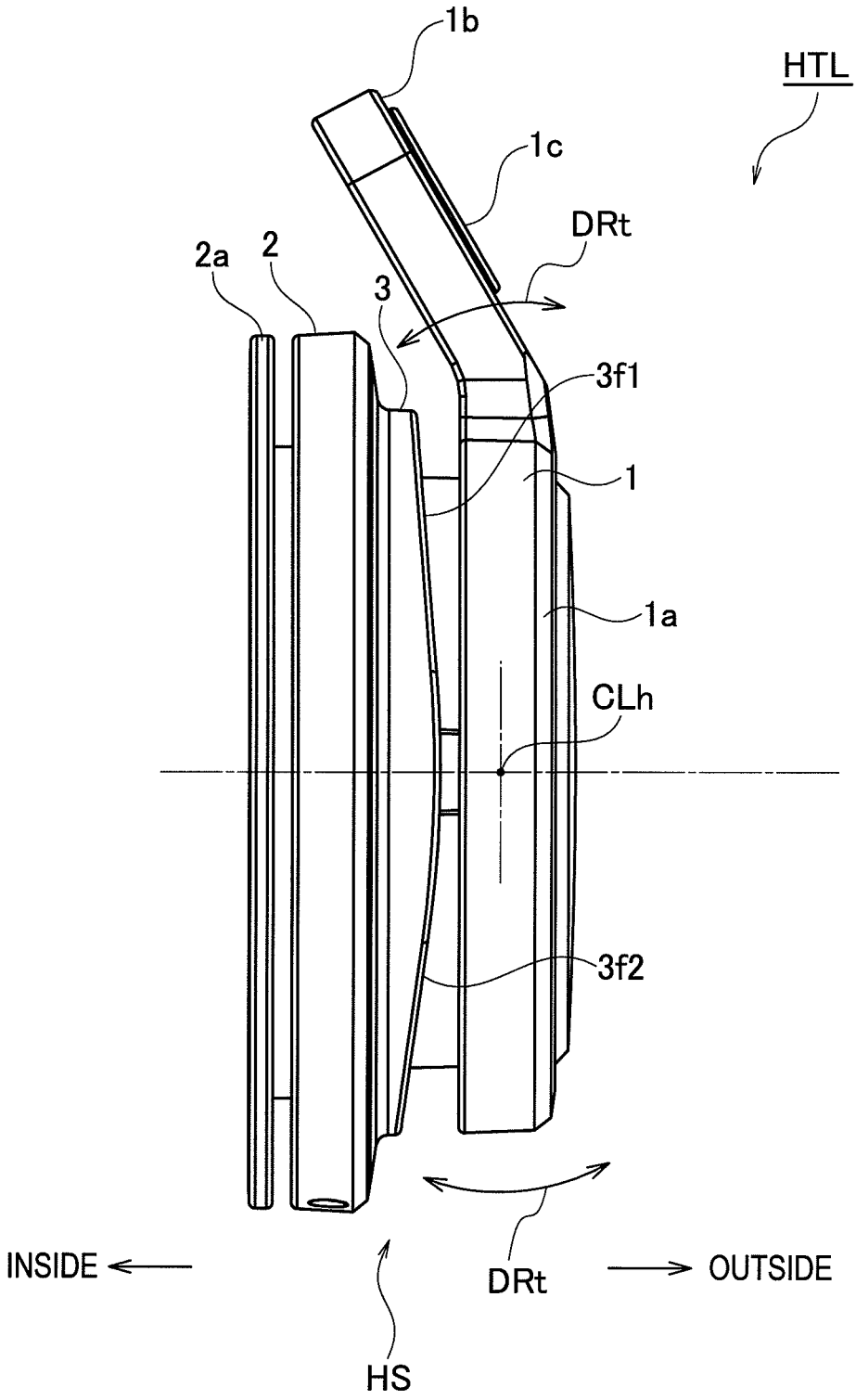
FIG. 3 is a side view of a main unit of the embodiment of the headphone.
Figure 4:
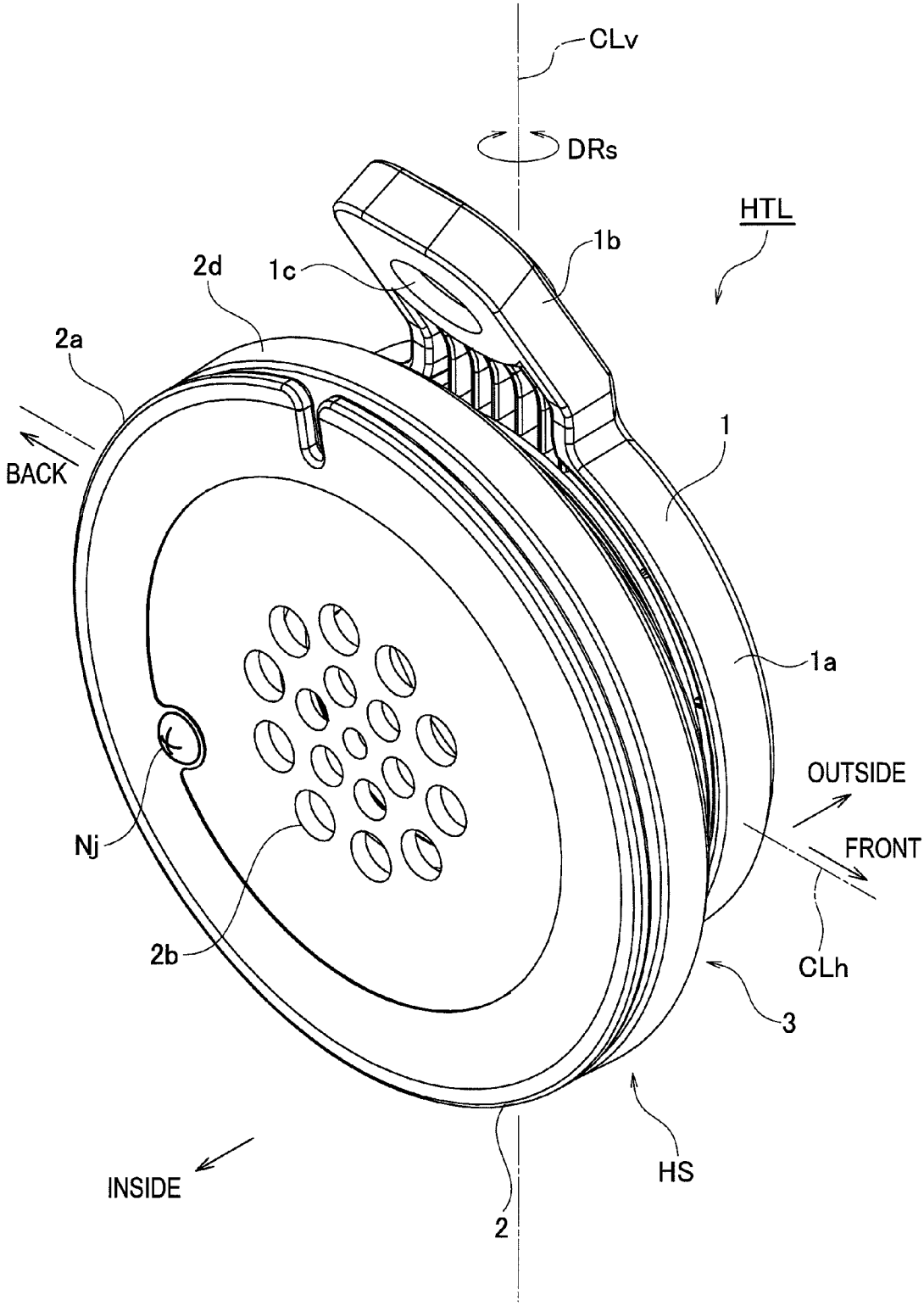
FIG. 4 is a perspective view of the main unit of the embodiment of the headphone.

With reference to mainly FIGS. 3 and 4, the schematic configuration of the housing HS is described.

FIG. 3 is a plan view of the main unit HTL from the front side of FIG. 2. FIG. 4 is a perspective view of the main unit HTL from the upper front as seen from the backside of the page of FIG. 2. FIGS. 3 and 4 both show the main unit HTL with the ear pad EP removed.

The housing HS includes: a baffle 2, which is located on the head side when the headphone 51 is worn over the head; and a case 3, which is located on the outer side. The baffle 2 inside and the case 3 outside are combined.

The baffle 2 includes a flange 2*a* on the inner side. The ear pad EP is attached to the flange 2*a*. Moreover, the baffle 2 includes plural sound emission holes 2*b* in central part. Sound from the speaker SP, which is accommodated within the housing HS, is emitted through the sound emission holes 2*b* to the outside.

With reference to FIGS. 5 to 8, the members are described in detail.

First, the baffle 2 is described in detail with reference to mainly FIG. 5.

Figure 5:
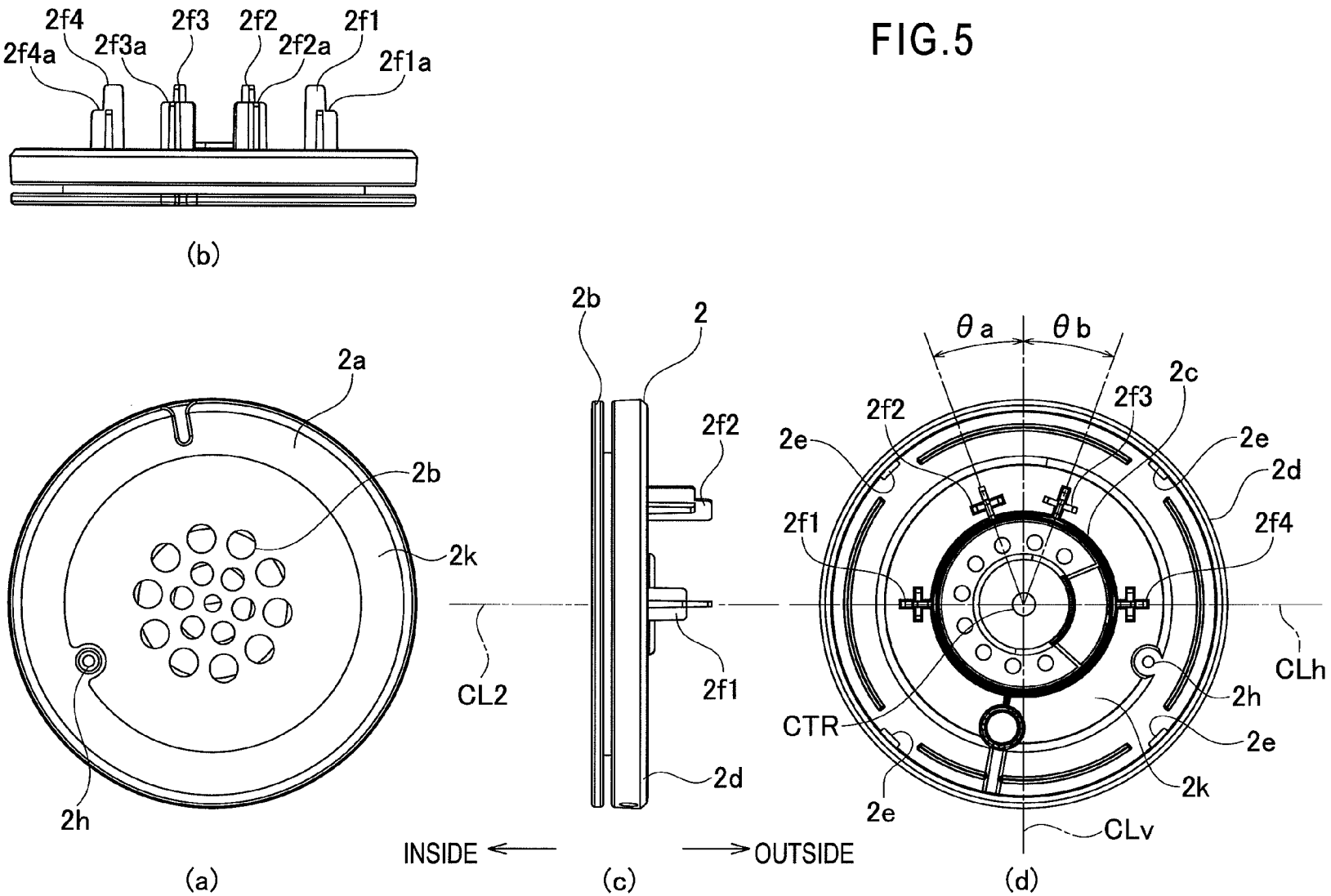
FIG. 5 is a four-side view of a baffle of the embodiment of the headphone.

FIG. 5 is a four-side view of the baffle 2. In FIG. 5, (a) is a front view of the baffle 2; (b), a top view thereof; (c), a right side view thereof; and (d), a back view thereof.

The baffle 2 is made of resin and includes a base 2*k*, which is formed in a substantially circular plate-shape. On the inside of the base 2*k*, the flange 2*a* is formed as described above. In the center of the base 2*k*, the plural sound emission holes 2*b* are formed.

At the center of the outer surface of the base 2*k*, a circular rib 2*c* is formed. The speaker SP is attached to the part surrounded by the rib 2*c*. At the edge of the outer surface of the base 2*k*, a peripheral wall 2*d*, which protrudes outward, is formed. On the inner surface of the peripheral wall 2*d*, four engagement protrusions 2*e* protruding toward the center are formed so as to be separated from each other.

On the outer surface of the base 2*k*, four ribs 2*f*1 to 2*f*4 are stood. The four ribs 2*f*1 to 2*f*4 are located at substantially equal distances from the center CTR of the base 2*k* in the radial direction. As for the circumferential direction, the ribs 2*f*1 and 2*f*4 are provided on the horizontal axis CLh, and the ribs 2*f*2 and 2*f*3 are respectively provided at an angle θa clockwise and at an angle θb counterclockwise from the vertical axis CLv, which is orthogonal to the axis CLh.

In the example of FIG. 5, θa=θb.

In the base 2*k*, a through hole 2*h* is formed. Through the through-hole 2*h*, a male screw Nj (see FIG. 4) is inserted to fasten the baffle 2 and the case 3 which are engaged with each other by a bayonet structure later described. The male screw Nj is a tapping screw, for example. Hereinafter, the male screw Nj is referred to as a tapping screw Nj.

As shown in (b) of FIG. 5, the ribs 2*f*1 to 2*f*4 are provided with step portions 2*f*1*a* to 2*f*4*a* at the tops thereof, respectively. An arch bracket 5 is inserted into a rectangular regions corresponding to the step portions 2*f*1*a* to 2*f*4*a*. The details thereof are described later.

Next, the case 3 is described in detail with reference to mainly FIGS. 6 and 7.

Figure 6:
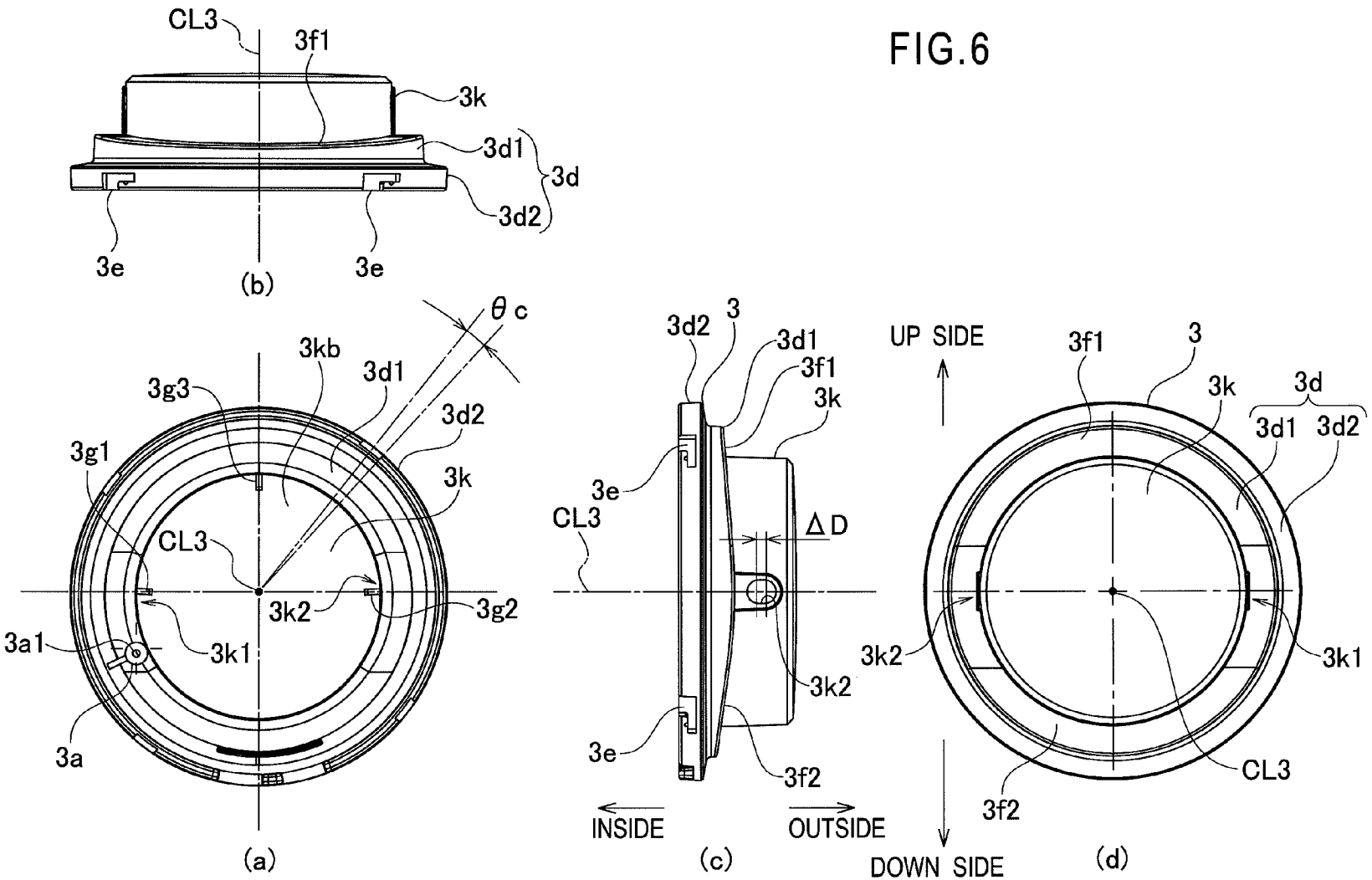
FIG. 6 is a four-side view of a case of the embodiment of the headphone.
Figure 7:
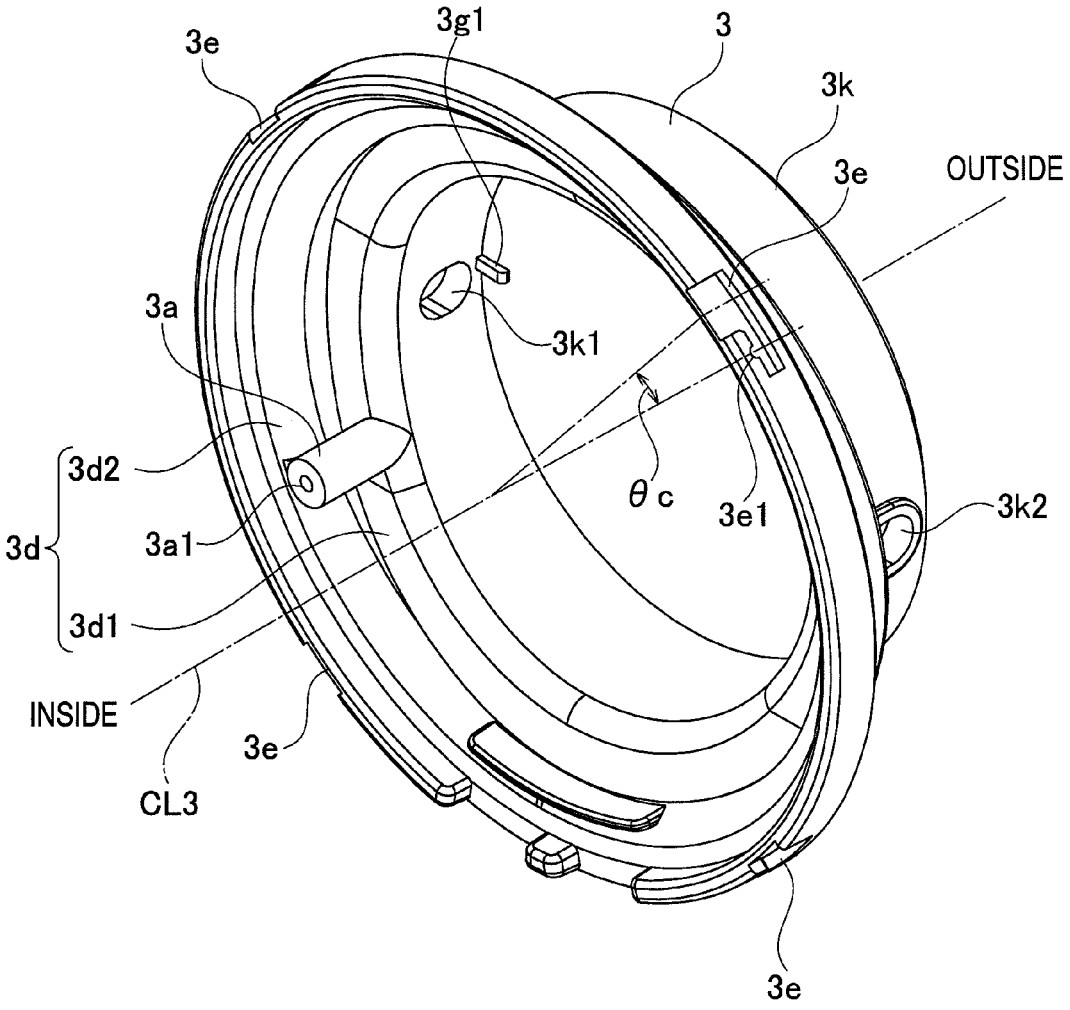
FIG. 7 is a perspective view of the case of the embodiment of the headphone.

FIG. 6 is a four-side view of the case 3. In FIG. 6, (a) is a front view of the case 3; (b), a top view thereof; (c), a right side view thereof; and (d), a back view thereof. FIG. 7 is a perspective view of the case 3.

The case 3 includes a base 3*k* having a pan shape with a closed bottom and a step portion 3*d* which increases stepwise in diameter starting from the edge of the base 3*k*. The case 3 is made of resin.

The step portion 3*d* includes a first step portion 3*d*1 and a second step portion 3*d*2, which are arranged in this order from the base 3*k* side.

In (a) of FIG. 6, a boss 3*a* is provided on the inner surface of the first step portion 3*d*1. The boss 3*a* protrudes in the axis CL3 direction and is provided with a tap drill hole 3*a*1.

In the base 3*k*, a pair of through-holes 3*k*1 and 3*k*2 are formed at the positions opposite to each other in a radial direction. The through-holes 3*k*1 and 3*k*2 are elongated holes longitudinal in the axis CL3 direction.

On the outer circumferential surface of the second step portion 3*d*2, four engagement recesses 3*e* are formed so as to be spaced from each other in the circumferential direction. Each of the engagement recesses 3*e* has a substantially L shape which extends from the edge of the second step portion 3*d*2 in the axis CL3 direction and bends in the circumferential direction. The engagement recesses 3*e* can be engaged with the engagement protrusions 2*e* of the baffle 2. The engagement recesses 3*e* and protrusions 2*e* are engaged with each other to integrate the baffle 2 and case 3.

The concrete engagement operation is as follows. The baffle 2 and case 3 are positioned so that the engagement recesses 2*e* and protrusions 3*e* correspond to each other and are then pressed in directions toward each other. The engagement protrusions 2*e* are engaged with portions of the engagement recesses 3*e* extending along the axis CL3.

Thereafter, the baffle 2 is rotated clockwise by an angle θc. The protrusions (not shown) provided on the surfaces of the engagement protrusions 2*e* of the baffle 2 on the inner side then fit into respective grooves 3*e*1 of the engagement recesses 3*e*, which provides a click feeling and holds the baffle 2 and case 3 stably at that position. This is a so-called bayonet structure.

Furthermore, the tapping screw Nj is inserted into the through-holes 2*h* and is screwed into the drill hole 3*a*1, thus integrating the baffle 2 and case 3 more stably.

The surface of the first step portion 3*d*1 on the outer side includes inclined surfaces 3*f*1 and 3*f*2. Upper part of the inclined surface 3*f*1 is inclined inward, and lower part of the inclined surface 3*f*2 is inclined inward.

On a bottom surface 3*kb* of the inside of the base 3*k*, ribs 3*g*1 and 3*g*2 are formed at the radial positions corresponding to the through-holes 3*k*1 and 3*k*2, respectively. At the top of the inside of the base 3*k*, a rib 3*g*3 is formed.

Next, the hanger 1 is described in detail with reference to FIGS. 8 to 10.

Figure 8:
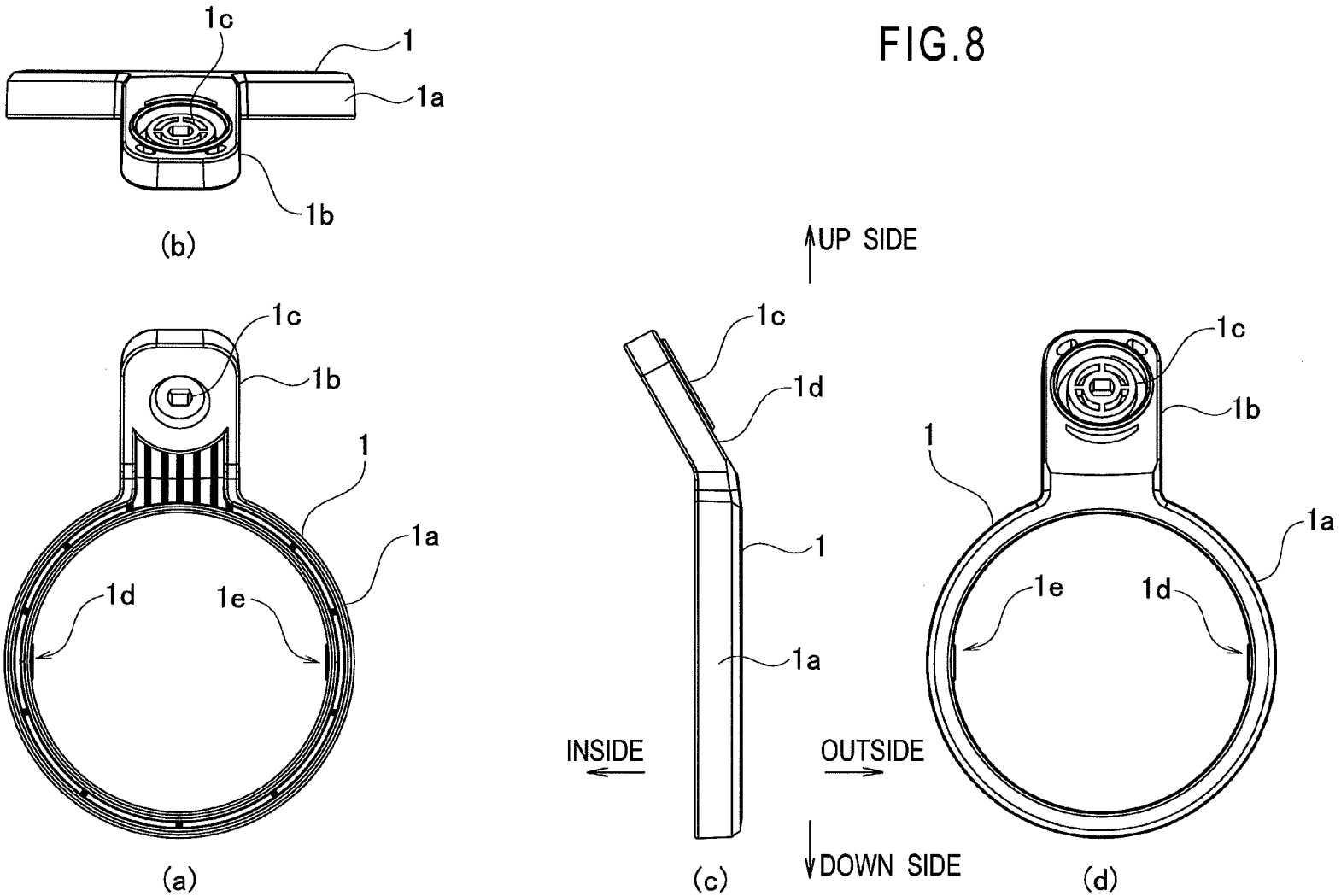
FIG. 8 is a four-side view of a hanger of the embodiment of the headphone.
Figure 9:
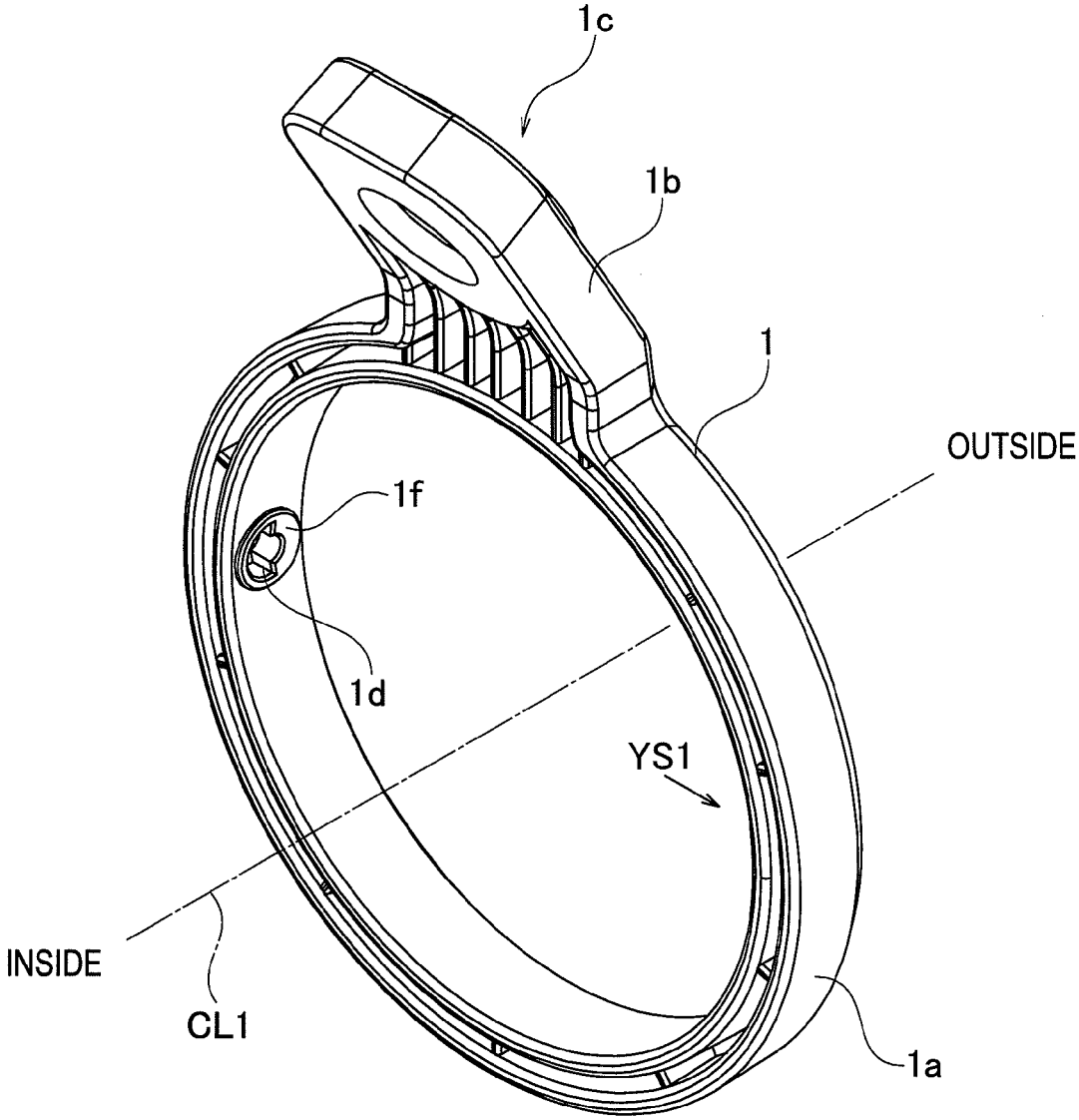
FIG. 9 is a perspective view of the hanger of the embodiment of the headphone.

FIG. 8 is a four-side view of the hanger 1. In FIG. 8, (a) is a front view of the hanger 1; (b), a top view thereof; (c), a right side view thereof; and (d), a back view thereof. FIG. 9 is a perspective view of the hanger 1. FIG. 10 is a partial plan view of a main portion (the engagement hole le) of the hanger 1 which is seen in the direction of an arrow YS1 of FIG. 9.

The hanger 1 includes the connecting portion 1*a* having a circular ring-shape and the arm portion 1*b* protruding from the connecting portion 1*a* outward in the radial direction at an inward slight inclined angle. The hanger 1 is made of resin. The arm portion 1*b* includes a headband engagement portion 1*c*, which is engaged and connected with the headband HB.

In (a) of FIG. 8, the pair of engagement holes 1*d* and 1*e*, whose bottoms are closed, are formed in a radial direction orthogonal to the direction that the arm portion 1*b* of the connecting portion 1*a* extends.

Figure 10:
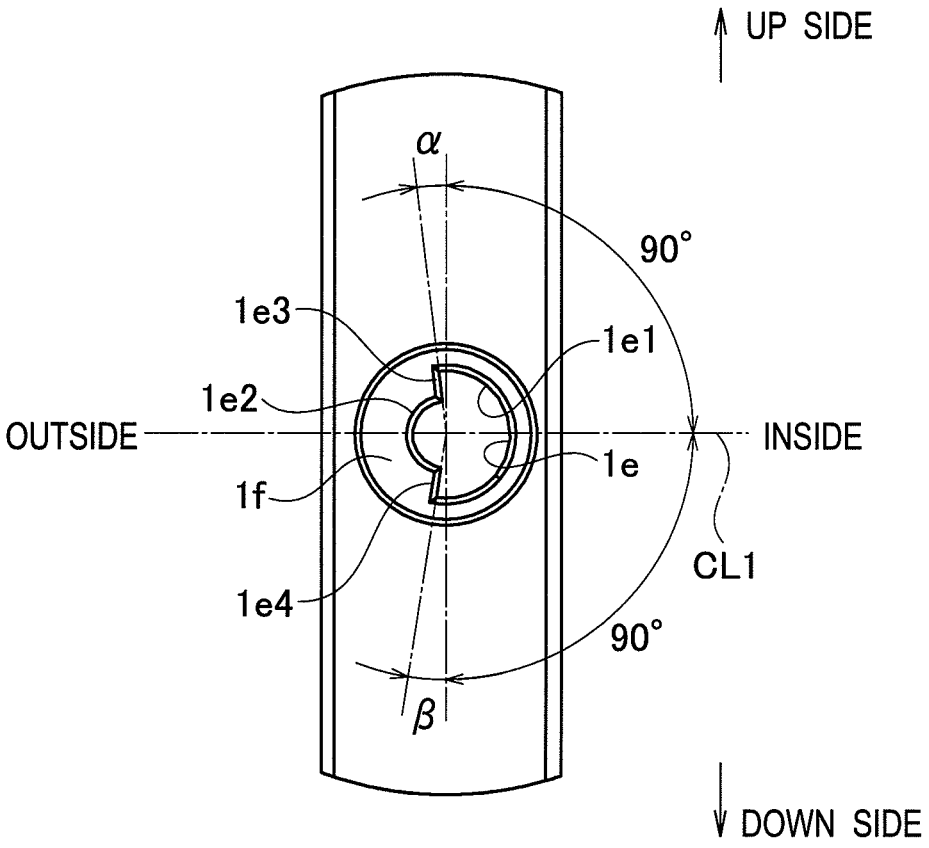
FIG. 10 is an enlarged view of a main portion of the hanger of the embodiment of the headphone.

In FIG. 10, the engagement hole 1*e* is provided for a seating 1*f*, which is a little protruded so as to form a circular flat surface.

The engagement hole 1*e* includes a large-diameter circumferential surface 1*e*1, a small-diameter circumferential surface 1*e*2, and abutment surfaces 1*e*3 and 1*e*4 connecting the both circumferential surfaces 1*e*1 and 1*e*2 in the radial direction.

Specifically, the circumferential surface 1*e*1 is formed in an angular range between (90+α) degrees above an axis CL1 and (90+β) below the same. In the example shown in FIG. 10, α degrees=β degrees. The engagement hole 1*d* has a same shape as the engagement hole 1*e* and has a large diameter circumferential surface on the inner side.

Next, the arch bracket 5 is described with reference to FIGS. 11 to 13. In the headphone 51, the arch bracket 5 connects the hanger 1 and case 3.

Figure 11:
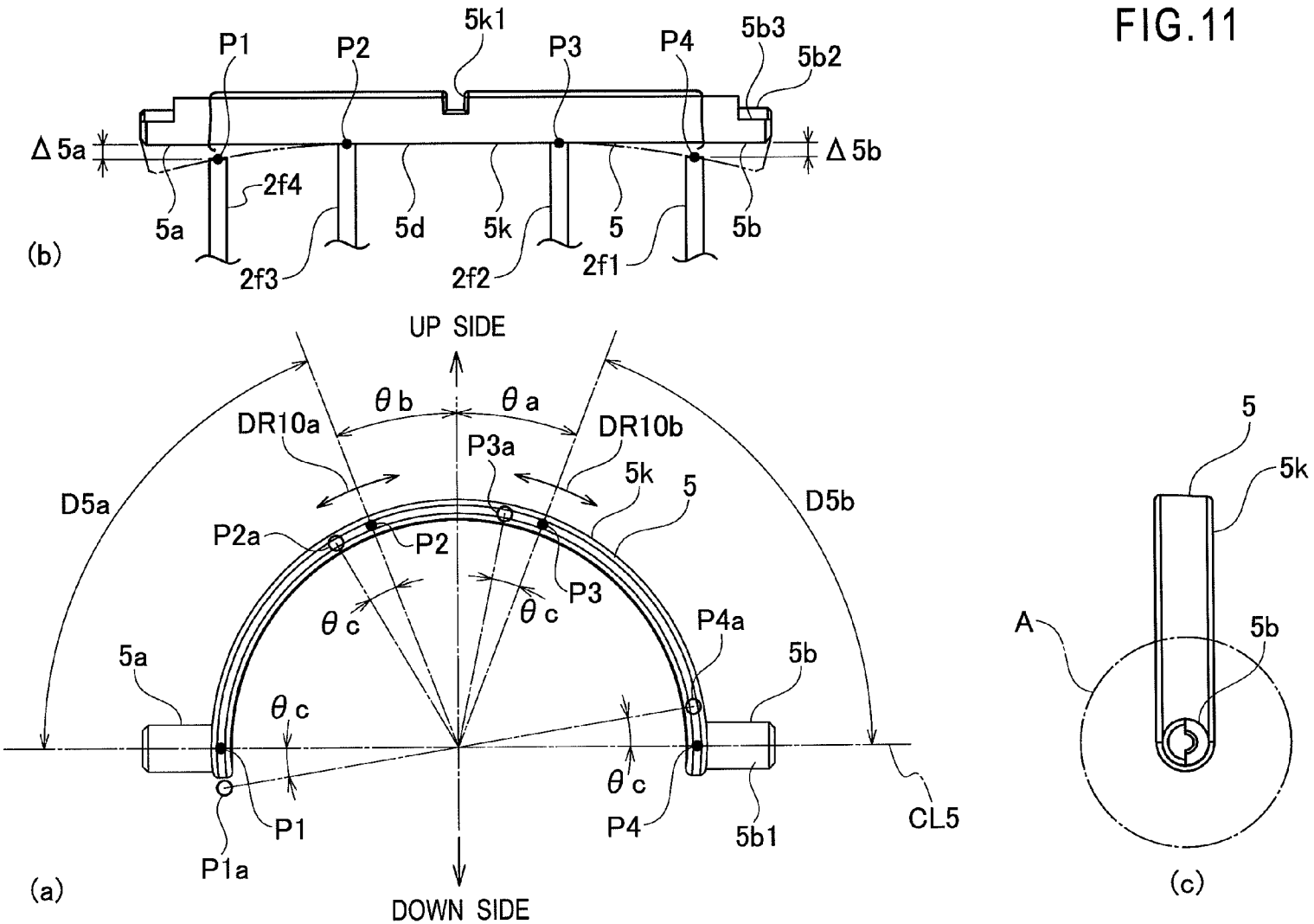
FIG. 11 is a three-side view of an arch bracket of the embodiment of the headphone.
Figure 12:
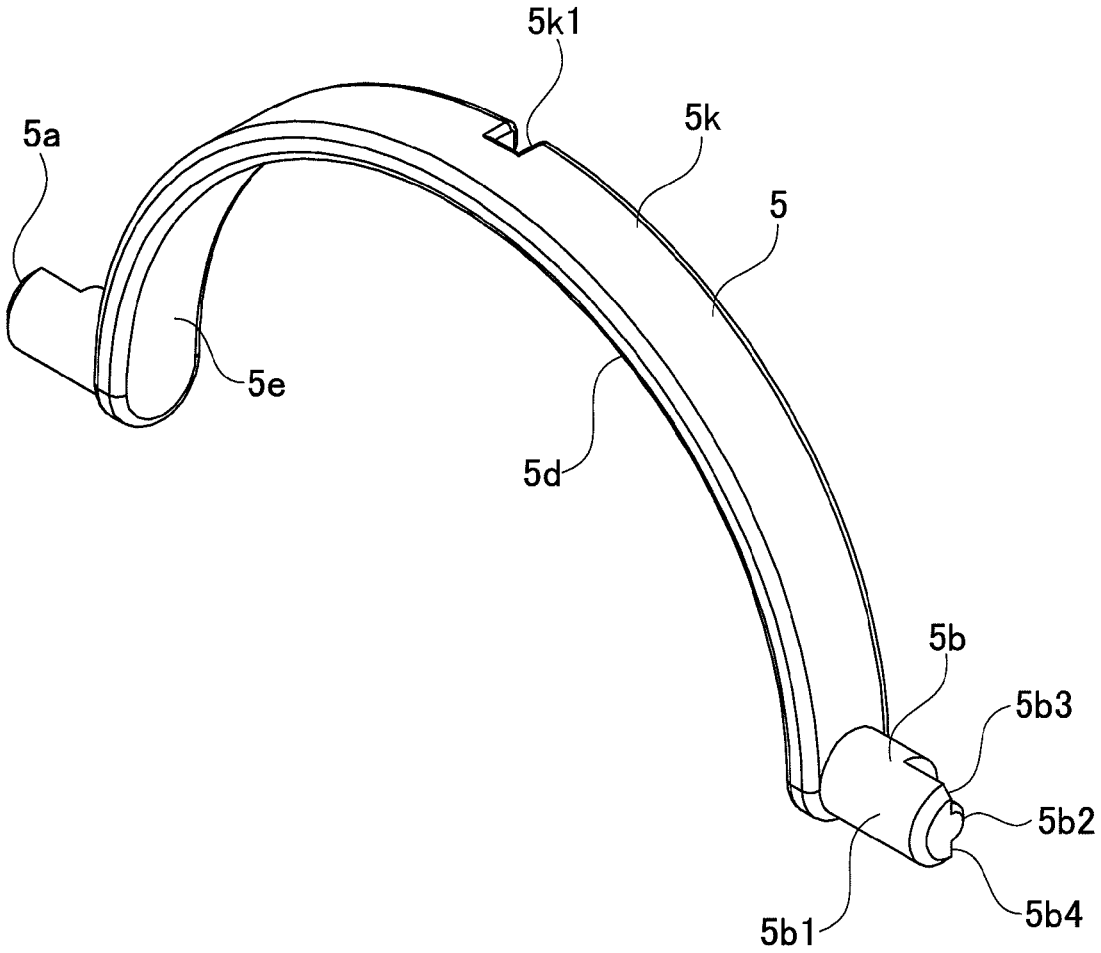
FIG. 12 is a perspective view of the arch bracket of the embodiment of the headphone.

FIG. 11 is a three-side view of the arch bracket 5. In FIG. 11, (a) is a front view of the arch bracket 5; (b), a top view thereof; and (c), a right side view thereof. FIG. 12 is a perspective view of the arch bracket 5. FIG. 13 is an enlargement view of part A of (c) of FIG. 11.

The arch bracket 5 includes a substantially semi-circular base 5*k* and a pair of protrusions 5*a* and 5*b* protruding outward in the radial direction from the both ends of the base 5*k*. The arch bracket 5 is made of resin having elasticity.

The base 5*k* has such a curved profile that can be accommodated along the inner circumferential surface of the base 3*k* in the base 3*k* of the case 3.

The base 5*k* includes a notch 5*k*1 at the center in a side surface. The notch 5*k*1 is provided to be engaged with the rib 3*g*3 of the case 3 and prevent the case 3 from being attached to the arch bracket 5 in a wrong way (inside out).

In the arch bracket 5, in other words, the pair of protrusions 5*a* and 5*b* protrude in directions away from each other on an axis passing through the both ends of the curved base 5*k*.

Figure 13:
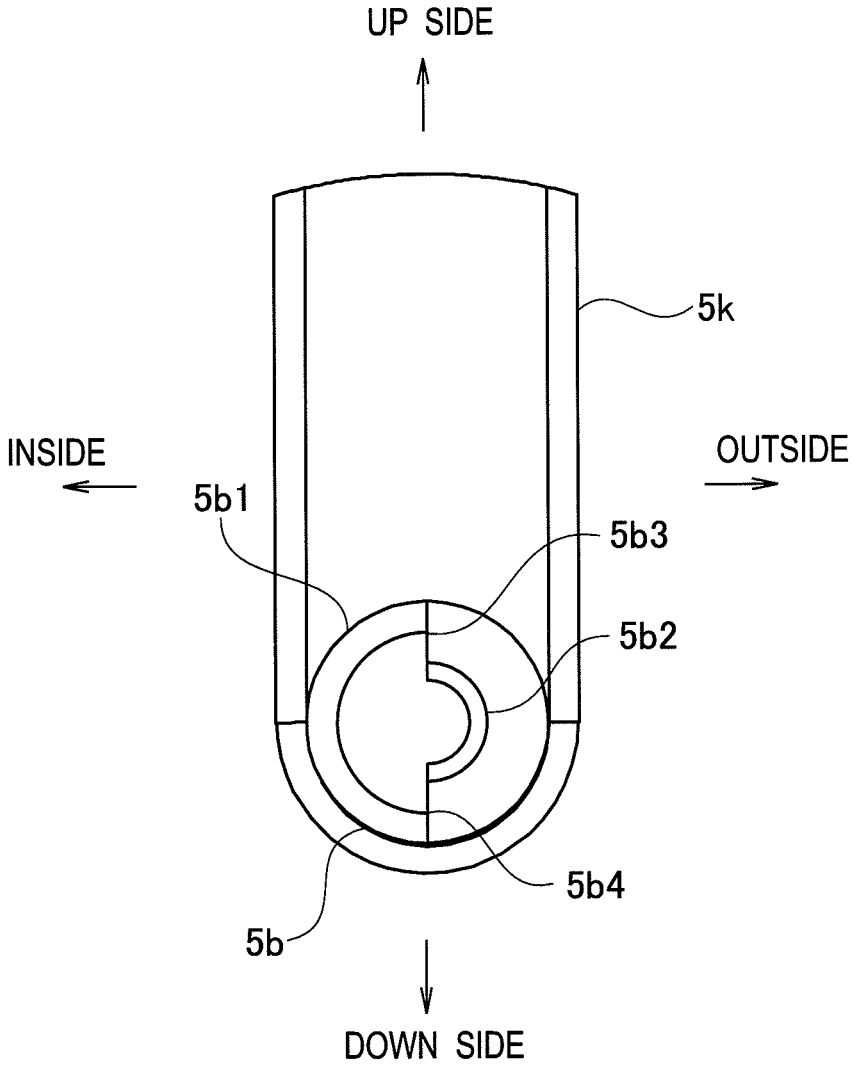
FIG. 13 is an enlarged view of a main portion of the arch bracket of the headphone of the embodiment.

The protrusion 5*b*, which is shown in detail in FIG. 13, includes a large-diameter circumferential surface 5*b*1, a small-diameter circumferential surface 5*b*2, and abutment surfaces 5*b*3 and 5*b*4 connecting the both circumferential surfaces 5*b*1 and 5*b*2 in the radial direction. The circumferential surfaces 5*b*1 and 5*b*2 are formed in ranges of 180 degrees separated on the inner and outer sides, respectively. The abutment surfaces 5*b*3 and 5*b*4 are on a same plane vertically extending.

The protrusion 5*a* has a symmetrical shape to the protrusion 5*b*. In the protrusion 5*a*, a large-diameter circumferential surface is formed on the side opposite to the notch 5*k*1 in a similar manner to the protrusion 5*b*.

The protrusions 5*a* and 5*b* are rotatable in respective predetermined angular ranges when being engaged with the engagement holes 1*d* and 1*e* of the hanger 1, respectively.

Figure 14:
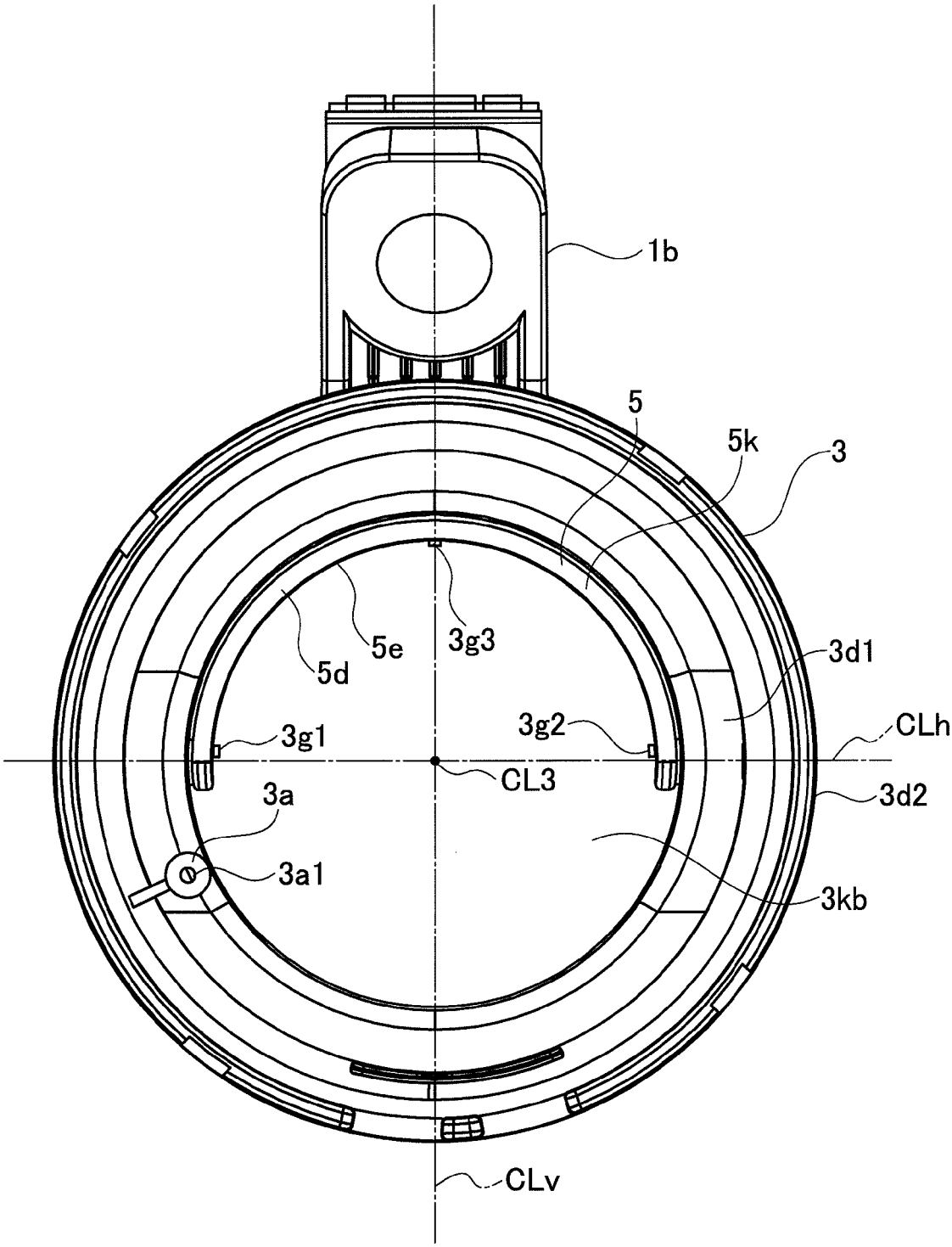
FIG. 14 is a plan view illustrating the embodiment of the headphone in the assembly process.
Figure 15:
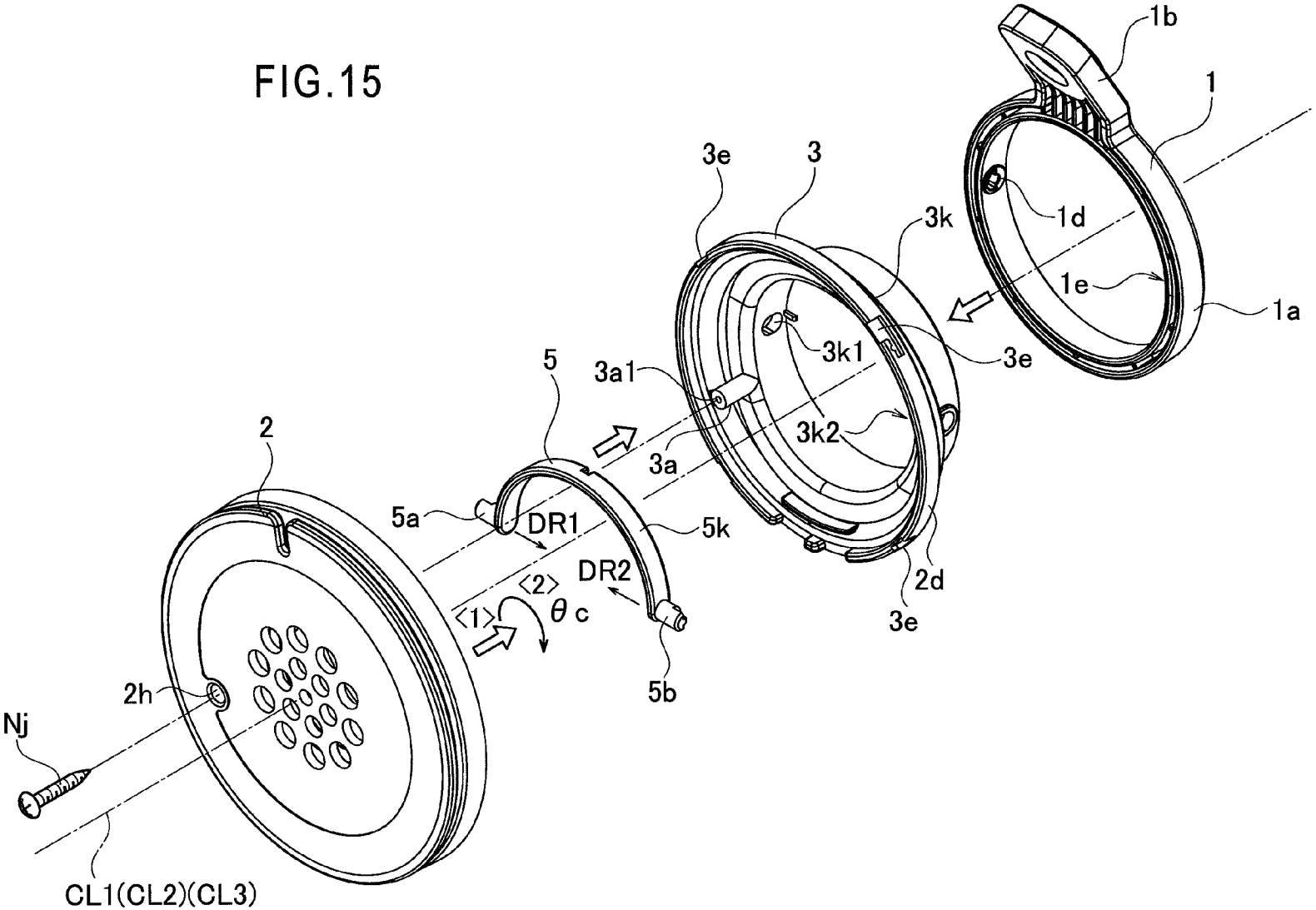
FIG. 15 is an exploded view of the embodiment of the headphone.

Next, a description is given of a process of assembling the main unit HTL in detail with reference to mainly FIGS. 14 and 15. FIG. 14 is a plan view showing the hanger 1 and case 3 integrated using the arch bracket 5. FIG. 15 is an exploded view of the main unit HTL.

The speaker SP is previously attached to the baffle 2.

First, the base 3*k* of the case 3 is inserted into the ring-shaped connecting portion 1*a* of the hanger 1. The hanger 1 and case 3 are then positioned so that the engagement holes 1*d* and 1*e* correspond to the through-holes 3*k*1 and 3*k*2 of the case 3, respectively.

Next, the arch bracket 5 is deformed so that the both ends thereof come close to each other (in the directions of arrows DR1 and DR2) and is inserted into the base 3*k* of the case 3. Thereafter, the deformed bracket 5 is released to insert the protrusions 5*a* and 5*b* into the through-holes 3*k*1 and 3*k*2 of the case 3, respectively. The protrusions 5*a* and 5*b* are then engaged with the engagement holes 1*d* and 1*e* of the hanger 1, respectively.

The protrusions 5*a* and 5*b* have enough protruding lengths to pass through the through-holes 3*k*1 and 3*k*2 and fit into the engagement holes 1*d* and 1*e*, respectively.

Thereafter, the baffle 2 is engaged with the case 3 by the bayonet structure as described above. Specifically, the baffle 2 and case 3 are positioned so that the engagement protrusions 2*e* correspond to the engagement recessed 3*e* and are then pressed against each other as indicated by <1> of FIG. 15. The engagement protrusions 2*e* are then engaged with the portions of the engagement recesses 3*e* extending along the axis CL 3.

Subsequently, as indicated by <2> of FIG. 15, the baffle 2 is rotated clockwise by the angle θc. The protrusions (not shown) provided on the surfaces of the engagement protrusions 2*e* of the baffle 2 on the inner side then fit into the grooves 3*e*1 of the engagement recesses 3*e*, which gives a click feeling and holds the baffle 2 and case 3 stably.

Next, the tapping screw Nj is inserted into the through hole 2*h* and is then screwed into the drill hole 3*a*1 of the boss 3*a* to integrate the baffle 2 and case 3 with the arch bracket 5 being accommodated inside.

Since the arch bracket 5 is made of resin having flexibility and is semicircular, in the process of elastically narrowing, inserting, and restoring the ends of the arch bracket, the protrusions 5*a* and 5*b* can be engaged with the engagement holes 1*d* and 1*e* of the hanger 1 very easily.

Moreover, since the protrusions 5*a* and 5*b*, which are respectively engaged with the engagement holes 1*d* and 1*e*, are connected and integrated by the base 5*k*. Accordingly, integration of the hanger 1 and case 3 requires only one additional part. Examples of the resin of the arch bracket 5 include POM (polyacetal).

When upper part of the housing HS is inclined toward the head side (inward) with the protrusion 5*b* being engaged with the engagement hole 1*e*, the abutment surface 5*b*3 comes into contact with the abutment surface 1*e*3 to limit the rotation of the housing HS. When lower part of the housing HS is inclined toward the head side (inward), the abutment surface 5*b*4 comes into contact with the abutment surface 1*e*4 to limit the rotation of the housing HS.

As shown in FIG. 10, the angle between the abutment surfaces 1*e*3 and 1*e*4 of the engagement hole 1*e* on the open side is 180 degrees+(α+β) degrees. The housing HS is therefore capable of tilting up by α degrees and down by β degrees.

In such a manner, the abutment surfaces 5*b*3 and 1*e*3 and the abutment surfaces 5*b*4 and 1*e*4 serve as rotation limiters which limit the angular ranges where the pair of protrusions 5*a* and 5*b* rotates, respectively.

As for the inclined surfaces 3*f*1 and 3*f*2 of the case 3, which are shown in FIGS. 3 and 6, inclination angles thereof for clearance are determined so that the case 3 does not come into contact with the hanger 1 in the process of tilting the housing HS. This is because if the hanger 1 and case 3 come into contact with each other, the contact sound thereof sometimes feels uncomfortable.

Figure 16:
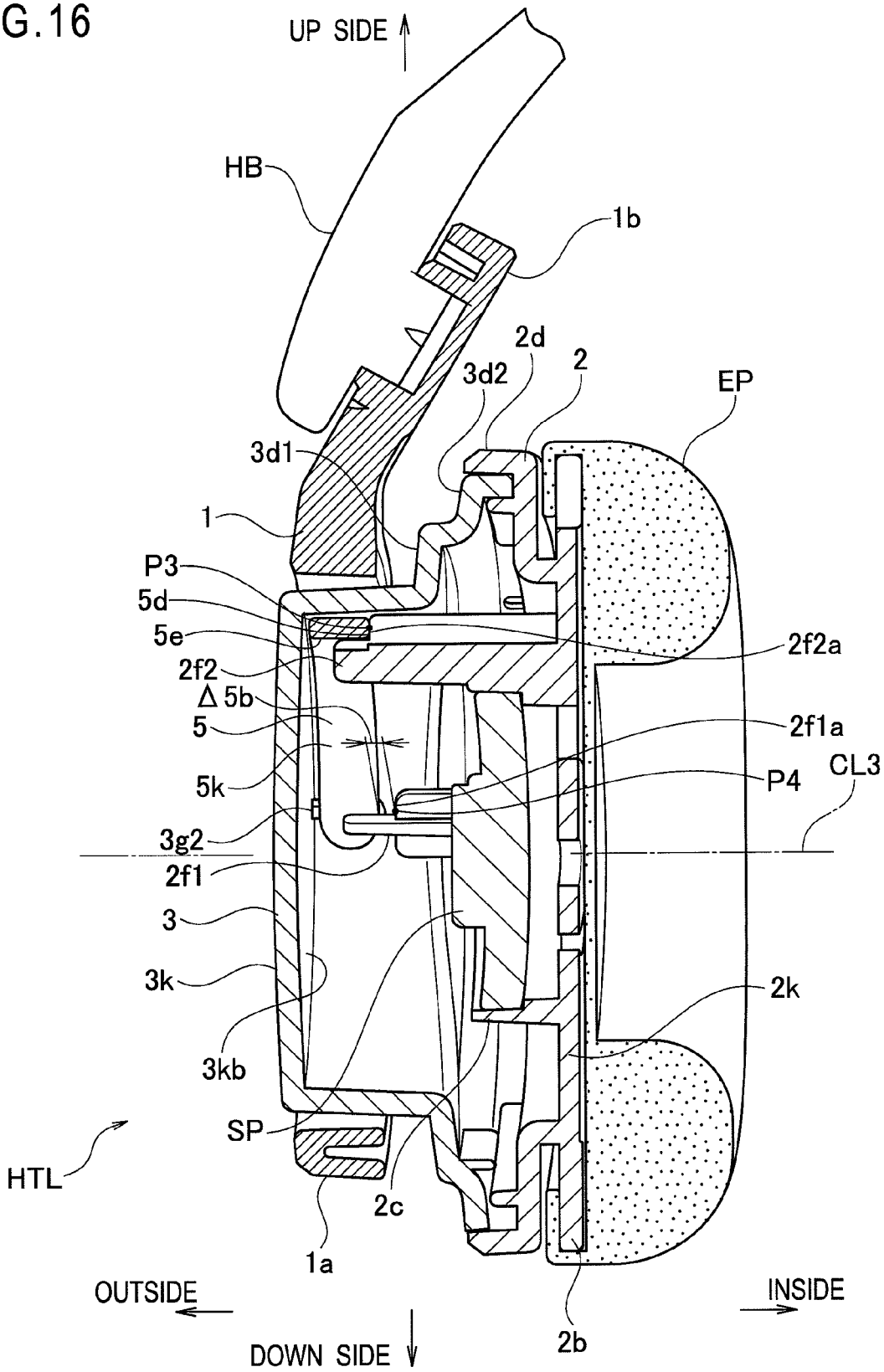
FIG. 16 is a cross-sectional view of the main unit of the embodiment of the headphone.

FIG. 16 is a cross-sectional view of the main unit HTL of the headphone 51 taken along a line S1-S1 of FIG. 2.

The arch bracket 5 is accommodated in the base 3*k* of the case 3. Outward movement of the arch bracket 5 accommodated in the case 3 is limited by the ribs 3*g*1 to 3*g*3 (see FIG. 14).

Inward movement of the arch bracket 5 is limited by the ribs 2*f*1 to 2*f*4 of the baffle 2, which is engaged with the case 3 by the bayonet structure.

The ribs 2*f*2 and 2*f*3 among the ribs 2*f*1 to 2*f*4 are in contact with or close to the arch bracket 5 so as to sandwich the arch bracket 5 in cooperation with the rib 3*p*3.

The arch bracket 5 is inserted in rectangular regions defined by the step portions 2*f*2*a* and 2*f*3*a* of the ribs 2*f*2 and 2*f*3 as recessed regions.

FIG. 16 shows the arch bracket 5 inserted into the rectangular regions defined by the step portion 2*f*2*a* of the rib 2*f*2 as the recessed regions.

An end surface 5*d* of the arch bracket 5 on the inner side and a surface 5*e* thereof on the axis CL3 side face each of the step portions 2*f*2*a* and 2*f*3*a*. The end surface 5*d* and the surface 5*e* are orthogonal to each other.

On the other hand, the ribs 2*f*1 and 2*f*4 of the ribs 2*f*1 to 2*f*4 are located at the positions corresponding to the protrusions 5*a* and 5*b* of the arch bracket 5, respectively.

The ribs 2*f*1 and 2*f*4 are provided so that a gap Δ5*a* (see FIG. 11) and a gap Δ5*b* (see FIGS. 11 and 16) are interposed between the ribs 2*f*1 and 2*f*4 and the arch bracket 5 in a natural state, respectively. This allows the ends of the arch bracket 5 to bend inward by elastic deformation and move inward (in the direction along the axis CL3) by predetermined distances.

When the ends of the arch bracket 5 bend inward and enter the recessed rectangular regions defined by the step portions 2*f*1*a* and 2*f*4*a*, which are provided in the tops of the ribs 2*f*1 and 2*f*4, both the end surface 5*d* of the arch bracket 5 on the inner side and the surface 5*e* on the axis CL3 side face each of the step portions 2*f*1*a* and 2*f*4*a*.

If the ends of the arch bracket 5 deform greatly, the end surface 5*d* and surface 5*e* will come into contact with the step portions 2*f*1*a* and 2*f*4*a*.

As for the arch bracket 5, by the ribs 2*f*1 to 2*f*4, inward movement of the end surface 5*d* is limited, and downward movement of the surface 5*e* is limited.

In such a manner, inward and downward movements of the arch bracket 5 (in the two directions) are limited, so that the arch bracket 5 can be accurately supported without rattling. The headphone 51 will not make abnormal noise such as rattling noise even when the headphone 51 is shaken. The headphone 51 is therefore provided to a user as a high-quality product.

The limitation of movements of the arch bracket 5 is schematically described in detail with reference to FIG. 11.

As shown in (a) and (b) of FIG. 11, the rib 2*f*3 is in contact with or close to the arch bracket 5 at a position P2 of an angle θb counterclockwise from the vertical axis CLv. The rib 2*f*2 is in contact with or close to the arch bracket 5 at a position P3 of an angle θa clockwise from the vertical axis CLv.

Since the gaps Δ5*a* and Δ5*b* are interposed between the arch bracket 5 and the ribs 2*f*4 and 2*f*1, respectively, the portions of the arch bracket 5 between the positions P2 and P3 and the respective ends thereof can elastically bend as indicated by chain double-dashed lines. In (b) of FIG. 11, the deflections are shown in an exaggerated fashion for easy understanding.

The through holes 3*k*1 and 3*k*2 of the case 3, through which the protrusions 5*a* and 5*b* of the arch bracket 5 are inserted, have elongated circular shapes longitudinal in the axis CL3 direction so as to allow displacement of the protrusions 5*a* and 5*b* due to such elastic deflection.

The protrusions 5*a* and 5*b* bend so as to be separated from the axis CL5. The longitudinal direction of the through holes 3*k*1 and 3*k*2 is therefore set corresponding to the direction that the protrusions 5*a* and 5*b* bend. Moreover, each of the through holes 3*k*1 and 3*k*2 is formed so that length ΔD (see (c) of FIG. 6) of parallel sides of the elongated circle is not less than the gap Δ5*a* or Δ5*b*.

By using elastic deformation of the both arms and forming the through holes 3*k*1 and 3*k*2 in the case 3 in such shapes (for example, elongated circles) that allow deformation of the arch bracket 5, the main unit HTL can be configured to swivel.

The weight (the degree of resistive force) on swivel can be controlled by changing the positions P3 and P2 of the ribs 2*f*2 and 2*f*3, which come in contact with or close to the arch bracket 5, to the right or left in (a) of FIG. 11 (see circular arrows DR10*a* and DR10*b* in (a) of FIG. 11).

The longer the distances between the positions P2 and P3 and the respective ends in the arch bracket 5 (hereinafter, also referred to as lengths of deformed arm portions), the lighter the swivel. In other words, the spring constants of the deformed arm portions can be easily optimized.

The weight on swivel can be changed also by changing the cross-sectional shape of the arch bracket 5. The cross-sectional shape of the base 5*k* may be designed so that the flexural rigidity in the direction of bending is optimized at the process of swivel. Specifically, the wall thickness and width of the arch bracket 5 are properly selected, or whether to provide slits and notches for the arch bracket 5 is determined.

Moreover, the resistive force in the process of inclining the front side of the housing HS inward (toward the head side) by swivel can be easily made different from the resistive force in the process of inclining the back side of the housing HS inward by swivel.

If the arch bracket 5 is produced with varied spring constants at the deformed arm portions, the case 3 and hanger are prepared as common parts, thus preventing the manufacturing cost of the headphone 51 from increasing.

In the main units HTL and HTR, the arch bracket 5 is fixed as follows without the need for additional exclusive parts. The arch bracket 5 is sandwiched by the rib 3*g*3 provided for the case 3 and the ribs 2*f*2 and 2*f*3 provided for the baffle 2, and the positions of the ribs 2*f*2 and 2*f*3 are naturally determined to the predetermined positions by bayonet engagement of the case 3. That is to say, the arch bracket 5 is sandwiched by the case 3 and baffle 2 to be supported.

A concrete description is given with reference to (a) of FIG. 11. The ribs 2*f*1 to 2*f*4 are located at the positions P1*a* to P4*a* when the engagement protrusions 2*e* are located corresponding to the engagement recesses 3*e* in the process of fitting the baffle 2 to the case 3 by bayonet engagement.

The positions P1*a* to P4*a* are at the angle θc counterclockwise from the positions P1 to P4, respectively. By relative clockwise rotation of the angle θc in the process of bayonet engagement, the ribs 2*f*1 to 2*f*4 move from the positions P1*a* to P4*a* to the predetermined positions P1 to P4, respectively.

Such a structure can prevent an increase in cost without requiring additional parts. Moreover, the position of the arch bracket 5 sandwiched by the ribs is stable and can be accurately determined. Accordingly, very few defective products are produces, and the quality of good products can be kept extremely high.

Moreover, the arch bracket 5 is pressed and held at plural separate places in the base 5*k* by the plural ribs 2*f*2 and 2*f*3, which are spaced from each other.

Accordingly, the base 5*k* will not be inclined or displaced and can be firmly held in the housing HS. According to this structure, the headphone 51 in use will not make unnecessary abnormal noise.

In the arch bracket 5, the both ends of the base 5*k* are free so that the pair of protrusions 5*a* and 5*b* bend by predetermined amounts in the direction away from the axis CL5, which passes through the ends of the base 5*k* in a natural state, for example, in the direction orthogonal to the extended surface of the base 5*k*.

Moreover, the pair of through-holes 3*k*1 and 3*k*2 is formed in such shapes that allow predetermined amounts of deflection of the pair of protrusions 5*a* and 5*b*, respectively. In the description of the embodiment, the through-holes 3*k*1 and 3*k*2 are elongated holes but not limited to elongated holes.

In a conventional hanger having a ring-shaped connecting portion, even if a pair of support pins, which are formed in the connecting portion and protruded so as to come close to each other in the radial direction, are tried to be attached to insertion holes of the housing provided corresponding thereto, it is difficult to attach the support pins to the insertion holes by elastically deforming and widening the conventional hanger like a U-shaped hanger because the conventional hanger has a closed ring-shape.

Moreover, it is examined that a boss is integrally formed in the housing and is engaged with a recess provided for the hanger. However, the hanger cannot be deformed and widened much, and the amount of engagement between the boss and the recess needs to be small. When such a headphone falls, the hanger can be easily detached.

In order to increase the amount of engagement so that the boss cannot be easily detached due to fall of the headphone or the like, it is examined that the boss is bonded and fixed to the housing by a later process. However, this requires an additional process of applying an adhesive. Furthermore, since the hanger cannot be elastically deformed and widened very much, it is difficult to diassemble the headphone and to repair the same. Accordingly, such a hanger is not preferable and is desired to be improved.

On the other hand, the headphone 51 of the above-described embodiment can be easily diassembled and can be repaired although the hanger includes the ring-shaped connecting portion.

Moreover, in one of conventional attachment methods, a pair of separate members equivalent to the support pins are inserted into the insertion holes from the inside of the housing and are fixed to the connecting portion instead of the support pins formed in the connecting portion of the hanger including a ring-shape connecting portion.

Such a case requires at least two additional parts, thus increasing in cost. Accordingly, there is a demand for an improvement in cost reduction.

On the other hand, according to the headphone 51 of the aforementioned embodiment, even though the hanger includes a ring-shaped connecting portion, it is possible to prevent an increase in cost and achieve low cost.

The embodiment of the present invention is not limited to the aforementioned configuration and includes a modification without departing from the scope of the present invention.

The shape of the connecting portion la of the hanger 1 is not limited to a circle and may be another closed shape such as an ellipse, an elongated circle, a polygon, or a combination thereof.

The case 3 is provided with the three ribs 3*g*1 to 3*g*3, but the number of such ribs is not limited to three and may be four or more. Moreover, the baffle 2 is provided with the four ribs 2*f*1 to 2*f*4, but the number of such ribs is not limited to four and may be five or more.

As described above, even though the hanger includes the ring-shaped connecting portion, the main units of the headphone 51 of the embodiment can swivel, and the headphone 51 can provide a good fit.

According to the headphone 51 of the embodiment, even though the hanger includes the ring-shaped connecting portion, it is possible to prevent an increase in the number of parts and therefore achieve lower cost.

According to the headphone 51 of the embodiment, although the hanger includes the ring-shaped connecting portion, the headphone 51 can be easily assembled and diassembled.

What is claimed is:

1. A headphone comprising:

a housing accommodating a speaker therein, which includes a pair of through holes opposite to each other in a radial direction of the housing;

a headband;

a hanger connected to the headband, which includes: a connecting portion formed in a ring-shape; and a pair of engagement portions opposite to each other in a radial direction of the connecting portion, the engagement portions being at positions corresponding to the pair of through holes; and a bracket which is accommodated in the housing and includes: a flexible curved base; and a pair of protrusions protruding at both ends of the base portion in directions away from each other on an axis penetrating the both ends, wherein the bracket connects the housing and the hanger by a configuration in which the pair of protrusions is inserted into the pair of through holes, protrudes therefrom, and is engaged with the pair of engagement portions.

2. The headphone according to claim 1, wherein in the bracket, both ends of the base are free ends to allow the pair of protrusions to bend by predetermined amounts in a direction away from the axis, and the pair of through holes is formed in shapes which allow the pair of protrusions to bend by the predetermined amounts.

3. The headphone according to claim 2, wherein the pair of through holes are elongated holes longitudinal in a direction that the pair of protrusions bends.

4. The headphone according to claim 1, wherein the bracket has a plurality of portions held by ribs provided for the housing.

5. The headphone according to claim 1, wherein the pair of protrusions is rotatably engaged with the pair of engagement portions.

6. The headphone according to claim 5, further comprising a rotation limiter which controls an angle of rotation of each of the pair of protrusions within a predetermined range.

7. The headphone according to claim 1, wherein the housing includes a first casing and a second casing which are combined, the first casing being located on a head side and the second casings being located on an outer side when the headphone is in use, the bracket is accommodated in one of the first or second casings, one casing includes the pair of through holes, and the bracket is sandwiched and supported by the first and second casings.

8. The headphone according to claim 7, wherein the first and second casings include engagement structures which are engaged with each other by relative rotation thereof, and the other one of the first or second casings includes a rib which allows the bracket to move to the predetermined position by the rotation.

* * * * *

UNITED STATES PATENT AND TRADEMARK OFFICE

CERTIFICATE OF CORRECTION

PATENT NO. : 8,774,441 B2
APPLICATION NO. : 13/614439
DATED : July 8, 2014
INVENTOR(S) : Takayuki Miyazawa It is certified that error appears in the above-identified patent and that said Letters Patent is hereby corrected as shown below:

In the Claims

Claim 1, Column 10, Line 52: Please delete “the” between “penetrating” and “both”.

Signed and Sealed this
Sixteenth Day of December, 2014

Michelle K. Lee

Michelle K. Lee
*Deputy Director of the United States Patent and Trademark Office*